United States Patent [19]

Wu et al.

[11] 4,347,709

[45] Sep. 7, 1982

[54] DEMAND DEFROST SENSOR

[75] Inventors: M. T. Wu, Madison, Wis.; Thomas Y. Chai, Freeport, Ill.

[73] Assignee: Honeywell Inc., Minneapolis, Minn.

[21] Appl. No.: 225,919

[22] Filed: Jan. 19, 1981

[51] Int. Cl.[3] ..... F25D 21/02; G08B 19/02

[52] U.S. Cl. ..... 62/140; 62/151; 340/580

[58] Field of Search ..... 62/140, 151, 138, 128; 340/580; 244/134 F; 324/61 R

[56] References Cited

U.S. PATENT DOCUMENTS

| | | | |
|---|---|---|---|
| 2,577,779 | 12/1951 | Lindberg | 340/580 |
| 3,282,065 | 11/1966 | Flanagan | 62/140 |
| 3,408,566 | 10/1968 | Norwich | 324/61 R |
| 3,882,381 | 11/1973 | Gregory | 340/580 |

*Primary Examiner*—Albert J. Makay
*Assistant Examiner*—Harry Tanner
*Attorney, Agent, or Firm*—Laurence J. Marhoefer

[57] ABSTRACT

A demand defrost system in which a high resistive epoxy resin hermetically seals a capacitive sensor plate and a noise immune phase detector detects a phase shift caused by the build up of frost.

2 Claims, 6 Drawing Figures

DEMAND DEFROST SENSOR

BACKGROUND OF THE INVENTION

This invention relates to a practical, low cost system which operates on demand to initiate and to terminate a defrost cycle for refrigeration and heat pump systems, and more particularly to an improved system which uses a capacitive sensor to detect frost build up.

There have been proposals in the prior art for systems using capacitive sensors to sense the build up of frost on surfaces of a refrigeration or heat pump unit in order to initiate a defrost cycle. U.S. Pat. No. 2,904,968, issued Sept. 22, 1959, to J. A. Spencer, Jr., is an example of such prior art system. Although fundamentally sound, such an approach has not begn susceptable to practical low cost implementation, and has not found heretofore widespread acceptance.

To detect frost build up, a conductive plate is placed adjacent to the surface of the evaporator. The capacitive reactance between the plate and the surface varies as frost builds up on the surface. It will be appreciated that the conductive plate must be separated from the surface a distance which is sufficient to insure that no water in a liquid phase will be held between the plate and the surface due to surface tension.

An object of this invention is the provision of a capacitance demand defrost system which is simple, reliable in operation, and which can be readily implemented by means of integrated circuitry in order to realize low cost.

Briefly, this invention contemplates the provision of a demand defrost system in which a epoxy resin hermetically seals the conductive plate in order to minimize the leakage resistance between the plate and the surface. A noise immune phase detector detects a phase shift caused by the build up frost; when the build up exceeds a predetermined amount a defrost cycle commences, and when it recedes the cycle is automatically terminated.

DESCRIPTION OF THE INVENTION

Figure 1:
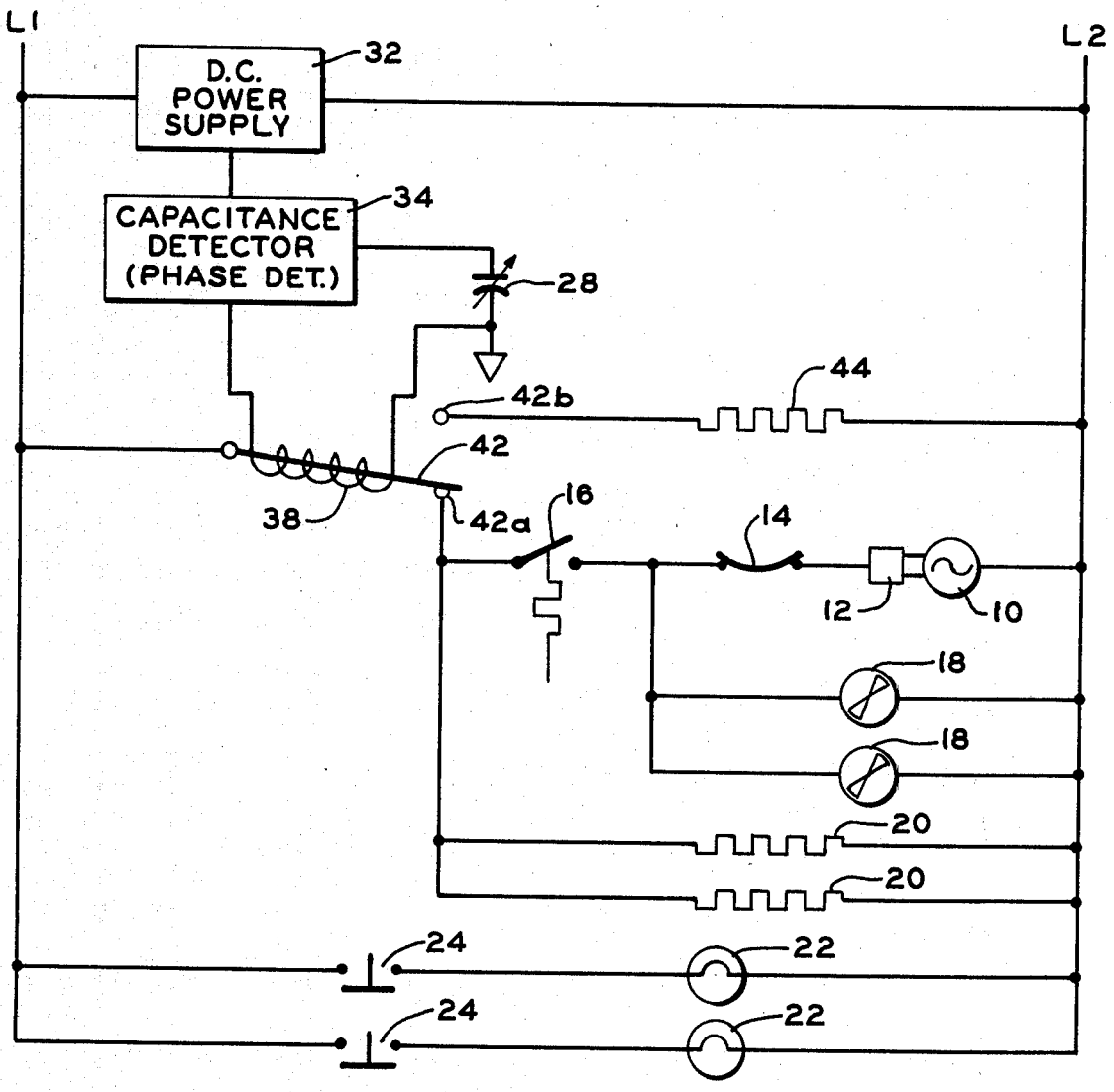
FIG. 1 is a partially schematic, and partially a block diagram view of a refrigeration system employing a demand defrost control system in accordance with the teachings of this invention.

Referring now to FIG. 1, a typical refrigeration unit powered from a 60 hertz line supply marked L1 and L2 has a conventional refrigeration motor 10, an overload protection relay 12 in series with an overload cutout switch, and a cycling thermostat 16. Also included are conventional cabinet fans 18, dew point heaters 20, interior lights 22, and door switches 24. It will be appreciated that the unit thus far described is intended to merely illustrate one typical setting in which invention is useful. It does not form any part of the invention itself.

The defrost control system includes a frost sensor 28, more fully described in connection with FIGS. 2 and 3, a DC power supply 32, connected between the power lines L1–L2, and a phase detector 34.

When the frost build up exceeds a predetermined amount, the detector 34 produces an output signal to activate an electronic switch. The switch connects power supply 32 to a heater coil 38. As the temperature of coil 38 rises, it causes a bimetalic switch 42 to switch from terminal **42*a* to terminal 42*b*. This switching action disconnects motor 10 and connects a defrost heater 44** between power supply lines L1 and L2 commencing a defrost cycle.

Similarly, when the frost recedes, the detector 34 detects the increase in the capacitive reactance of sensor 28, and disconnects coils 38 from power supply 32. Coil 38 cools. Bimetalic switch 42 switches from terminal **42*b* to 42*a*, disconnecting the defrost heater 44 and reconnecting motor 10**.

Figure 2A:
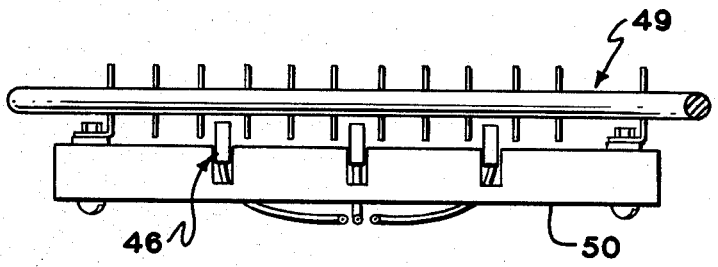
FIG. 2A is a plan view of the arrangement shown in FIG. 2.
Figure 2:
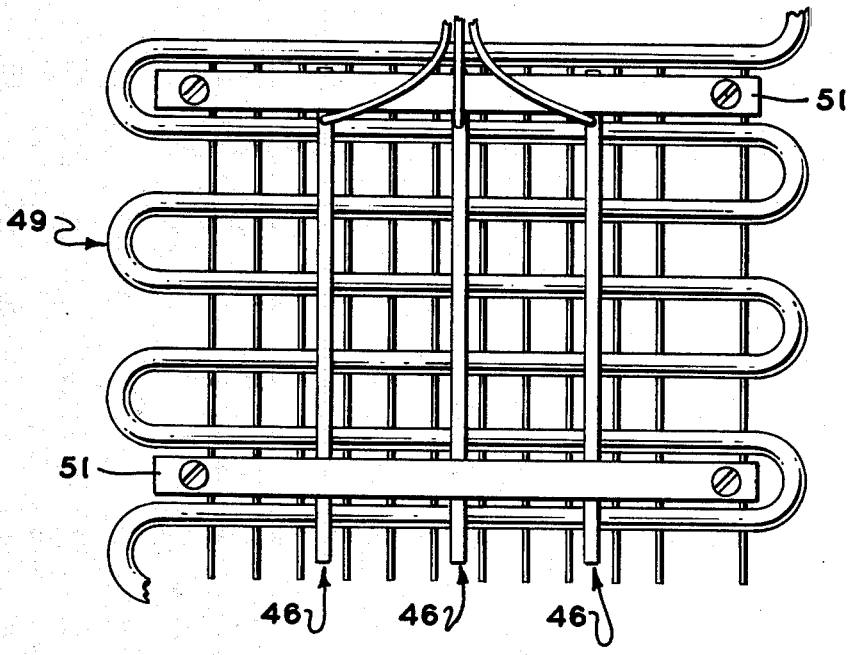
FIG. 2 is a front view of capacitive plates disposed adjacent a refrigeration surface.

Referring now to FIGS. 2 and 2A the frost sensor comprises conductive plate or plates 46 of a suitable material, such as aluminum. The plate is spaced a short distance from a refrigerating evaporator surface 49 and is preferably co-extensive with at least a large portion of surface. In this way the capacitance reactance is a function of the average frost build-up, and the system is relatively insensitive to local variations in build up. A pair of brackets 51 hold the plates 46 in place. Where a plurality of plates 46 are used they are connected in parallel.

Figure 3:
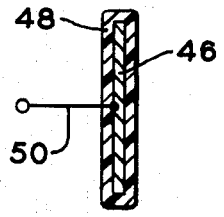
FIG. 3 is a sectional view of a capacitive plate for a demand defrost control system in accordance with the teachings of this invention.

As shown in FIG. 3, in order to minimize the effect of the leakage resistance between the surface 49 and the sensor plates 46, the sensor plates are hermetically sealed by encapsulating it within a coating of high resistive material 48 such as an epoxy resin. Preferably this coating has resistance on the order of 10 megoms or higher. A conductive lead 50 is attached to the plate 46.

Figure 4:
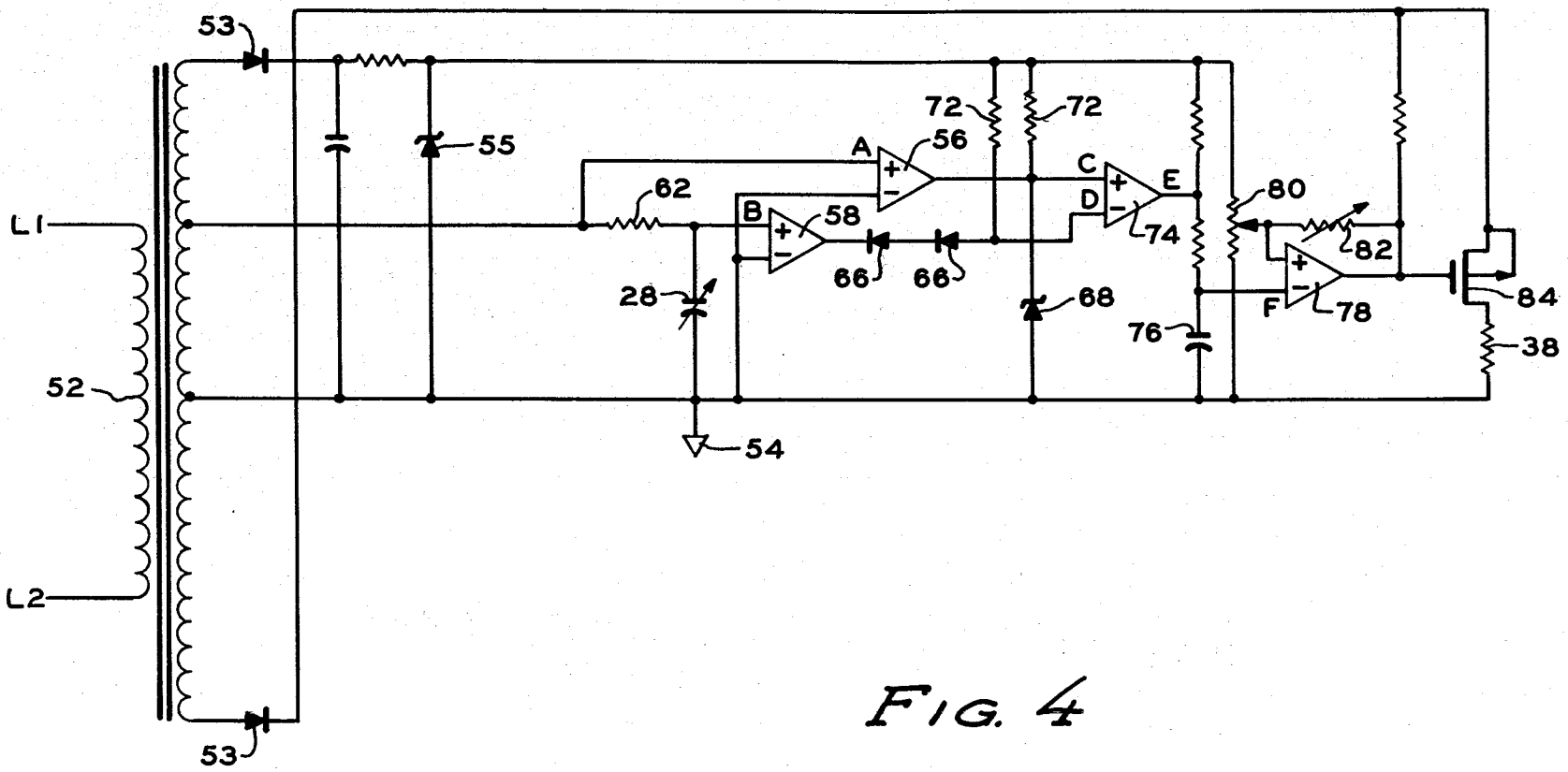
FIG. 4 is a schematic diagram of a preferred embodiment of a phase detector for detection of build up of frost between the capacitive plate and the surface of FIG. 2.
Figure 5:
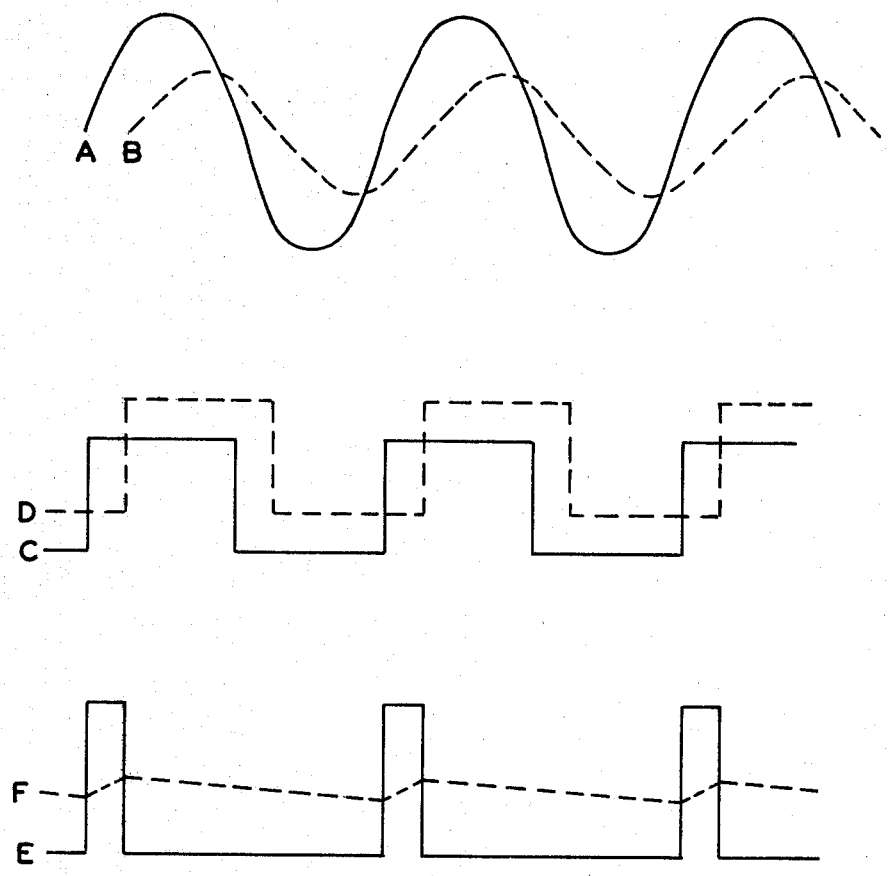
FIG. 5 is a an idealized diagram of wave forms at various points in the circuit of FIG. 4.

Referring now to FIG. 4, a schematic diagram of a preferred circuit for the practice of this invention, and FIG. 5 which shows wave forms at various points of the circuit, the line power between L1 and L2 is applied to the primary of a transformer 52 whose center tapped secondary is tied to a chassis common 54, the refrigerator chasis for example. Diodes 53 provide a rectified output from the secondary, and zenier diode 55 establish the DC operating voltage for the phase detector circuit.

An AC reference signal from L1–L2 is applied to the non-inverting terminal (+) of operational amplifier 56. This is signal A in FIG. 5. The AC signal from L1–L2 is also applied to non-inverting terminal (+) of an operational amplifier 58 via an RC network which includes resistor 62, and the capacitive sensor 28. This signal (B in FIG. 5) is phase shifted relative to A by an angle which is a function of capacitive reactance of the sensor 28.

The outputs of the operational amplifiers 56 and 58 respectively switch between ground and a positive potential established by diodes 66 and the zenier diode 68 in combination with the resistors 72. These two outputs are applied to another operational amplifier 74, and are shown at C and D of FIG. 5.

Amplifier 74 produces a series of output pulses of a predetermined amplitude whose duration varies as a function of phase displacement between the inputs at C and D. This output is shown at E of FIG. 4. Capacitor 76 integrates these pulses as a function of time to produce a DC (F in FIG. 5) which is applied to the inverting terminal of another operational amplifier 78. Variable resistors 80 and 82 establish a variable reference at the amplifier 78 which determine respectively the trigger level of the amplifier and its reset level.

When the potential across the integrating capacitor 76 exceeds the threshold established by the variable resistor 80, operational amplifier 78 produces an output which turns on MOS POWET switch 84 in series with the heater coil 38. A feedback resistor 82 maintains the amplifier 78 in an ON condition until the voltage across the integrating capacitor 76 drops to a predetermined value thus providing an adjustable differential between the value of capacitive reactance which turns the heater 38 on and off.

In operation, as frost builds up on the evaporator, the capacitance reactance between the evaporator surface 49 and the sensor plate 46 decreases. This decreasing capacitive reactance causes an increasing shift between the signals at points A and B which in turn increases the duration of the pulse output E. The voltage across the integrating capacitor 76 increases until the input to the inverting terminal of amplifier 78 exceeds the trigger level established by variable resistance 80. When this occurs, an output to the gate of switch 84 turns the switch on and current flows through the heater coil 38.

Heat from coil 38 cause bimetalic switch 42 to move from terminal 42*a* to terminal 42*b*. The defrost heater 44 is energized, and the normal cooling system is deenergized.

As the frost melts, the capacitive reactance of the sensor increases and the duration or pulse width of the output of amplifier 74 shortens. The potential across the integrating capacitor drops until it goes below the level established by the feedback resistor 82 at which time the enabling voltage is removed from the gate of the switch 84. The heater coil 38 is no longer energized, bimetalic switch 38 switches to its terminal 42*a*, and the defrost cycle ends, and the cooling cycle resumes.

Those skilled in the art will recognize that only preferred embodiments of the present invention is disclosed herein and that the embodiment may be altered and modified without departing from the true spirit and scope of the invention as defined in the accompanying claims.

What is claimed is:

1. A demand defrost sensor for sensing and controlling the frost build up on an evaporator surface, comprising in combination:

a conductive plate disposed adjacent said surface, said plate and said surface forming a capacitor;

a high resistive material encapsulating said plate;

a first and second operational amplifier;

means for coupling a source of AC reference signal to said first amplifier;

means including said capacitor and coupling said source of AC reference signal to said second amplifier;

means for comparing an output of said first and said second amplifier, said comparing means producing a series of output pulses whose width is a function of the phase shift caused by said capacitive coupling;

means to integrate said pulses, said integrating means producing a DC signal whose magnitude is a function of said pulse width; and means responsive to said DC signal for initiating and terminating a defrost cycle.

2. A demand defrost sensor for sensing and controlling the frost build up on an evaporator surface as in claim 1 including a plurality of conductor plates disposed adjacent said surface.

* * * * *